US005417508A

United States Patent [19]

Friedman

[11] Patent Number: 5,417,508

[45] Date of Patent: May 23, 1995

[54] REUSABLE/REFILLABLE SPIRAL BINDER

[76] Inventor: Michael N. Friedman, 7 Harbor Ct., Centerport, N.Y. 11721

[21] Appl. No.: 223,457

[22] Filed: Apr. 5, 1994

[51] Int. Cl.[6] ..... B42F 3/06

[52] U.S. Cl. ..... 402/19; 402/26; 402/57; 402/501

[58] Field of Search ..... 402/75, 79, 26, 79, 402/500, 501, 802, 20, 80 P, 80 R, 57

[56] References Cited

U.S. PATENT DOCUMENTS

| | | | |
|---|---|---|---|
| 2,051,738 | 8/1936 | Ottinger | 402/19 |
| 2,134,400 | 10/1938 | Grumbacher | 402/26 |
| 2,153,575 | 4/1939 | Kramer | 402/79 X |
| 2,188,680 | 1/1940 | Farkas | 402/26 |
| 2,228,110 | 1/1941 | Grumbacher | 402/26 |
| 2,228,355 | 1/1941 | Key | 402/26 |
| 2,681,655 | 6/1954 | Schade | 402/501 X |

FOREIGN PATENT DOCUMENTS

| | | | |
|---|---|---|---|
| 46019 | 8/1932 | Denmark | 402/26 |
| 1053277 | 2/1954 | France | 402/80 L |
| 1079661 | 12/1954 | France | 402/20 |

*Primary Examiner*—Frances Han
*Attorney, Agent, or Firm*—Murray Schaffer

[57] ABSTRACT

A reusable/refillable binder for papers and the like having marginal perforations. The binder includes a binding element having opposite coiled ends and a multiplicity of spiral coils disposed therebetween adapted to be received within the perforations in the papers in threaded relations thereof. Each coiled end of the binding element includes an aperture extending therethrough. A removable locking element is coupled to the aperture at each respective coiled end of the binding element and to one of the multiplicity of spiral coils to prevent rotation of the multiplicity of spiral coils and thus unbinding of the papers from the binder.

18 Claims, 2 Drawing Sheets

REUSABLE/REFILLABLE SPIRAL BINDER

FIELD OF THE INVENTION

The present invention relates generally to binders for papers and the like and, more particularly, to a reusable/refillable binder including a spiral binding element.

BACKGROUND OF THE INVENTION

Binding elements constructed of plastic or metallic wires which have been helically or spirally coiled and successively passed through perforations in the rear margin of papers, such as sheets and covers to form books and notebooks in bound form, are well known.

A narrow gauge wire or plastic is used to form the spiral binding element requiring a close pitch or space between the adjacent coils to better resist deformation and permanent distortion of the designed shape. Commonly, there are some 35 to 45 coils in a typical 11×8.5 spiral bound notebook.

It is now understood that if no provision is made to securely anchor such coils, the coils may, due to friction encountered in turning the sheets, handling, etc., gradually creep outward at one end or the other.

In order to overcome this problem, the ends of the spiral coils, usually of metal but sometimes of plastic, are crimped or bent to prevent the coils from rotating as a result. The present spiral binding elements cannot be refilled without great difficulty and inconvenience to the user.

It has been proposed to overcome the above-mentioned problems by locating a removable locking element at each end of the spiral coils. One of the problems arising with prior art binders employing this arrangement is that the locking elements are of a configuration which interferes with the free and uninterrupted 360 degree rotation of the papers so as to allow the papers to lie flat for writing or drawing purposes. The effect is particularly objectionable where the locking elements provide transverse abutments that cannot pass through the perforations in the papers, and will therefore prevent removal of the binding element from the papers and thereby hold the papers in assembled relationship. Also, when such locking elements come into contact with portions of the sheets, binding or mutilation of the sheets is apt to occur.

SUMMARY OF THE INVENTION

The present invention overcomes the disadvantages inherent in the above described prior art binders by providing a spiral binder including a binding element which can be easily and quickly threaded through the perforations of the sheets and covers or disconnected therefrom.

The spiral binder of the present invention is provided, at its coiled ends, with tapered leading edges and a plurality of spiral coils therebetween which makes it easier to refill, speeds up binding and unbinding time and could be economically molded or extruded of plastic or metal with a volume and shape resulting in a substantially stronger structure and having increased rigidity which aids in easier rotation of the spiral coils in or out of the bound papers.

A removable locking element is coupled to each end of the binding element to prevent screwing motion of the spiral coils and thus to prevent the binding element from uncoiling from the bound material, while allowing the locking elements to be easily removed and replaced.

The locking elements are of a suitable low profile shape, permitting the bound material to be rotated 360 degrees without compromising the bound material from laying flat for writing or drawing purposes and without binding or mutilating the bound material.

Briefly stated, the present invention comprises a reusable/refillable binder for papers and the like having marginal perforations. The binder includes a binding element having opposite coiled ends and a plurality of spiral coils disposed therebetween adapted to be received within the perforations in the papers in threaded relation thereof. Each coiled end of the binding element includes an aperture extending therethrough. A removable locking element is coupled to the aperture at each respective end of the binding element and to one of the plurality of spiral coils to prevent rotation of the plurality of spiral coils and thus unbinding of the papers from the binder.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF PREFERRED EMBODIMENTS

While this invention is susceptible of embodiments in many different forms, this specification and the accompanying drawings disclose only some specific forms as examples of the use of the invention. The invention is not intended to be limited to the embodiment so described, and the scope of the invention will be pointed out in the appended claims.

Figure 1:
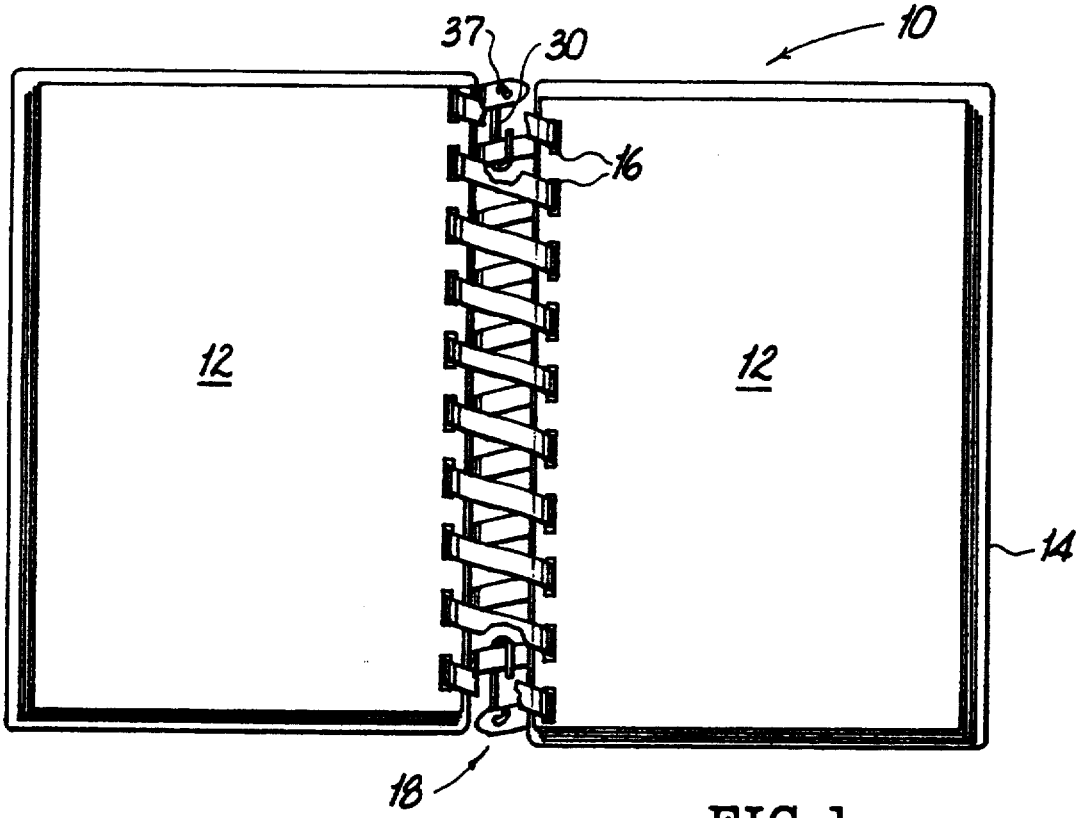
FIG. 1 is a view of a book bound in accordance with the present invention.

Referring now to the drawings in detail, wherein like numerals are used to indicate like elements throughout, there is shown in FIGS. 1 and a first preferred embodiment of a binder, generally designated 10, in accordance with the present invention. The binder 10 includes a stack of papers or the like such as sheets 12, which may, if desired, be arranged between front and back covers 14.

Each sheet 12 and cover 14 is provided with marginal perforations 16. The perforations are equidistantly spaced and correspond in spacing and arrangement so that they may be arranged in superposed position. The details of the type and structure of the papers which may bound with the binder according to the present invention are well understood by those skilled in the art and are not pertinent to the present invention. Accordingly, further description thereof is omitted for purposes of convenience only and is not limiting.

Figure 2:
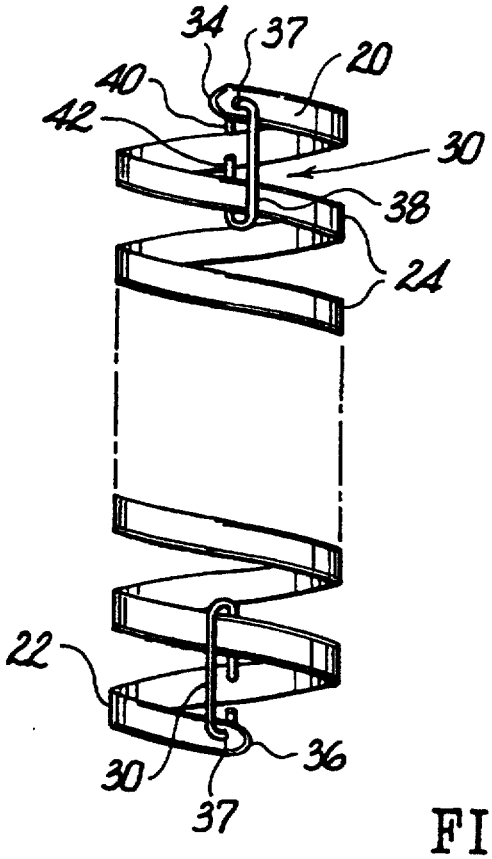
FIG. 2 is a view of a binding element of the binder shown in FIG. 1, illustrating a removable locking element in accordance with a preferred embodiment of the present invention.

As shown in FIG. 1, the sheets 12 and covers 14 of the bound book 10 are held in assembled or connected relation by a binding element, generally designated 18, in the form of a helical coil. As best shown in FIG. 2, the binding element 18 comprises opposite coil ends 20, 22 and a plurality of spiral coils 24 extending therebetween. It is understood by those skilled in the art that the pitch of the spiral coils 24 should be chosen to correspond to the spacings of the perforations 16 in the stack of sheets 12 and covers 14, so that the binding element 18 may be threaded into engagement with the stack 12 and covers by rotating it, turn by turn, through the perforations 16 (FIG. 1). For example, by choosing a pitch value to match the widely used $\frac{1}{8}\times 5/16$ inch rectangular holes with 9/16 inch centers, the spiral coil 24 could be fashioned with a cross-section of approximately $0.25\times 0.050$ inch, achieving a large pitch value with only 19 rings, for a standard 11 inch binding element dimension, and ample strength and resistance to twisting.

The coil ends 20, 22 are provided with a tapered leading edge as shown respectively at 34, 36. This feature combined with a properly chosen pitch value for the spiral coils 24 as discussed above greatly speeds up binding and unbinding time of the spiral element 18.

Preferably, the binding element 18 is molded or extruded of a flat strip of plastic material such as a suitable polymeric material. However, it is understood by those skilled in the art that other fabrication methods and materials are suitable for the binding element 18. For example, the binding element 18 may be molded or extruded from a suitable metal which is pliable such that it can be readily deformed and yet is sufficiently resilient to retain its preformed shape when subjected to normal strains after it is formed into a helical coil.

The coil ends 20, 22 are further provided respectively with apertures 37 for respective coupling to removable locking elements 30 as further described below.

Referring now to FIG. 2, there is shown a plan view of the binding element 18 employing a first preferred embodiment of the removable locking elements 30 according to the present invention which prevent the relative rotation of the sheets 12, covers 14 and spiral coils 24 and thus the unbinding of the sheets 12 and covers 14 from the binder 10 (FIG. 1).

The locking elements 30 include a body portion 38 having a first hooked end 40 and a larger second hooked end 42. Preferably, the locking elements are molded or extruded from a plastic material, as discussed above for the binding element 18, in the form of a wire or flat strip having a low profile in the longitudinal direction. However, it is understood by those of ordinary skill in the art that other shapes and forms or construction are suitable for the locking elements 30. For example, the locking elements may be formed from a suitable metal or a non-elastic, hard material such as a rigid plastic.

The assembly of the binder 10 to the coil will be described with reference to FIGS. 1 and 2. The binding element 18 is first threaded into engagement with the stack of sheets 12 and covers 14 by rotating it, turn by turn, through the perforations 16. Each locking element 30 is then manually located in place at each respective end 20, 22 of the binding element 18 by positioning the larger second hooked end 42 partially around the spiral coil 24, compressing the helical binding element 18 inboard toward a spiral coil 24 adjacent each respective coiled end 20, 22, and positioning the smaller first hooked end 40 through the aperture 37. Upon release of the locking element 30, the binding element 18 is relaxed to its preformed shape with the locking element 30 firmly securing the spring coils 24 to prevent rotation of the same and thus unbinding the sheets 12 and covers 14 as the binder 10 is handled or used.

It will be understood by those skilled in the art that the locking elements 30 prevent the binding element from uncoiling from the sheets 12 and cover 14 within the binder 10 while being capable of ready removal and replacement when servicing or refilling the binder with additional papers. A particular advantage of the locking element 30 according to the present invention is illustrated with reference to FIG. 3. When the pages are rotated 360 degrees, its longitudinal low profile shape permits the locking elements 30 to be kept parallel to the sheets 12 and covers 14 so as to not compromise the sheets or covers from laying flat for writing or drawing purposes.

Figure 3:
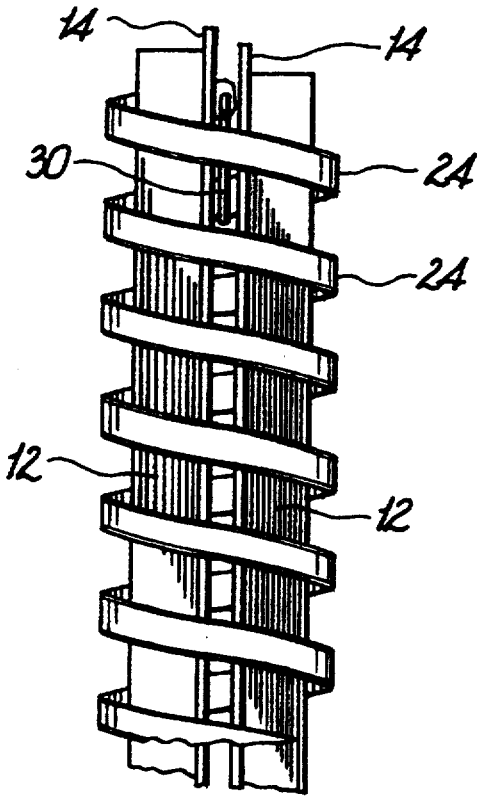
FIG. 3 is a fragmentary edge view of the book shown in FIG. 1, illustrating the papers fully rotated 360 degrees.
Figure 4:
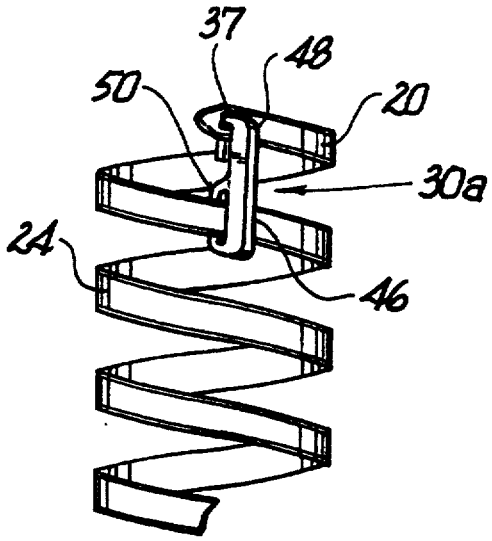
FIG. 4 is a plan view of the binding element shown in FIG. 2, employing a removable locking element according to a second preferred embodiment of the invention.

The binder according to a second embodiment of the invention, as shown in FIG. 4, includes the essential elements of the binder previously described with reference to FIGS. 1–3. However, in the second embodiment the removable locking element **30*a* includes a body portion 46, a first hooked end 48 and a second hooked end 50 defining a closed loop formed integrally with the body portion 46**.

The locking elements **30*a* of the present embodiment are also molded of high strength plastics, such as a suitable polymeric material. However, it is understood by those skilled in the art that other materials and forms of construction are suitable for the locking elements 30*a* as with the locking element 30 previously described with reference to FIGS. 1–3**.

The locking elements **30*a* are formed with a low profile shape in the longitudinal direction. As discussed above with reference to the first preferred embodiment, this low profile shape permits the locking element 30*a* to be kept aligned in parallel relation to the sheets 12 and covers 14** upon full 360 degree, unrestricted rotation of the sheets and covers. This feature permits the sheets and covers to lay flat for writing or drawing purposes.

According to a another feature of the present embodiment, the locking elements **30*a* may be formed with a wide surface area in its radial axis of alignment to the binding element 18. This provides a suitable fingerhold for better and easier manipulation of the locking element during assembly and disassembly of the binder as further described below. The wide surface area adds physical strength to the lock which may be otherwise compromised by its low profile longitudinal shape. Furthermore, the wide radial surface area of the locking element better protects the sheets 12 and covers 14** from damage when pressure is brought to bear between the sheets, covers and locking element as the sheets and covers are rotated 360 degrees during use.

Assembly of the binder according to the second embodiment is accomplished substantially in the same manner as with the binder 10 previously described with reference to FIGS. 1–3. However, the locking elements **30*a* are assembled by first passing the coiled end 20 of the binding element 18 through the closed loop defined by the second hooked end 50 until the second hooked end encircles the spiral coil 24 adjacent the coiled end 20. The coiled end 20 is then compressed inboard toward the adjacent spiral coil 24 until the aperture 37 is aligned with and subsequently engaged with the first hooked end 48 of the locking element. The coiled end 20 is then released from compression and will revert to its original pitch relating to the adjacent spiral coil 24. Thus, when the first hooked end 48 extends fully through the aperture 37 and the coiled end 20 is released from compression, no residual tension of a constant nature remains between the locking element 30***a* and the coiled end 20. The assembly of the locking element 30*a* at the coiled end 22 of the binding element 18 is effected in the same manner as discussed above for the coiled end 20.

An advantage according to the second embodiment is that the closed loop defined by the second hooked end 50 of each locking element 30*a* completely encircles or encloses the spiral ring 24 adjacent the respective coiled end 20, 22. This prevents dislodging and loss of the locking element 30*a* during use or handling of the binder without sacrificing the quick release quality that the present locking element offers. It will be understood by those skilled in the art that the closed loop defined by the second hooked end 50 should be of a cross-sectional shape conforming to the profile chosen for the spiral coils 24.

From the above description, it will be seen that the binder of the present invention is reusable and refillable by providing a binding element 18 which may be quickly and without difficulty unthreaded from the perforations in the sheets 12 and covers 14 for the purpose of removing or replacing one or more of the latter. The removable locking elements 30*a* provide absolute security in connecting the sheets and covers to the binding element 18 while preventing the spiral coils 24 of the binding element from rotating and thus unbinding the sheets and covers as the book is handled or used. Furthermore, the particular low profile of the locking elements 30*a* permit complete and unrestricted 360 degrees rotation of the sheets and covers without compromising the latter from laying flat for writing or drawing purposes.

It will also be understood by those skilled in the art that the wide radial surface area of the locking elements provides a suitable fingerhold for better and easier manipulation of the same during assembly and disassembly of the binder and protects the bound material as they are rotated 360 degrees during use.

Figure 5:
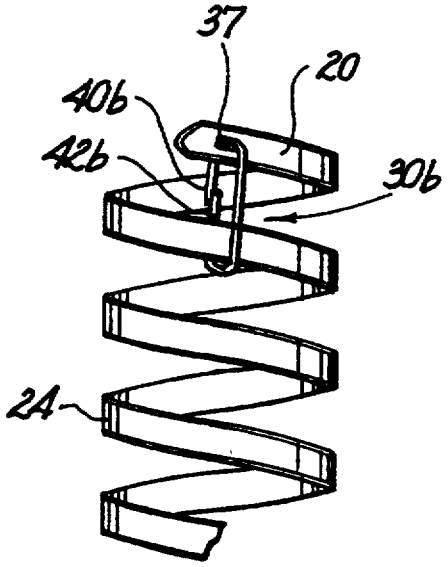
FIG. 5 is a plan view of a third embodiment of a binding element in accordance with the present invention.

The binder according to a third embodiment of the invention, as shown in FIG. 5, includes the essential elements of the binders previously described with reference to FIGS. 1–4. However, while in the third embodiment the removable locking element 30*b* is similar to that shown in FIGS. 1–3 in that it comprises a bent wire body, it is somewhat modified so that the first and second hooked ends 40*b* and 42*b* are elongated so that they overlap each other. In this manner, the hooked ends 40*b* and 42*b* lie in spring biased contact with each other so as to provide a snap-like fastener which is easily applied to the hole 37 and over one or more coils of the spiral. A ring having overlapping contacting ends, such as a conventional "key ring", may also be used.

The locking element 30*b* of the present embodiment is of a low profile in the longitudinal direction and the first and second hooked ends are coupled by resilient contacts. However, it is understood by those skilled in the art that other forms of connections are suitable for the hooked ends and without departing from the spirit and scope of the invention. It will also be appreciated by those skilled in the art that while metal wire is preferred, the locking element 30*b* could be molded from any of a series of well-known high strength plastic materials as previously described with reference to FIGS. 1–3.

As in the preceding embodiment, a third embodiment locking element 30*b* is attached at each end of the binder coil 18. Each element 30*b* is first encircled about the coils 24 and then its overlapping ends 40*b* and 42*b* spring open and the end 40*b* encircles into the opening 37 and then released to its closed position. The locking element 30*b* of the present embodiment has all of the advantages discussed with reference to FIGS. 1–3. Particularly, as with all the disclosed locking elements, when the sheets 12 and covers 14 (FIG. 1) are rotated 360 degrees, the locking elements 30*b*, being of a low profile in the longitudinal direction, will be and will remain aligned with and in parallel relation to the sheets and covers. This advantageous feature permits the sheets and covers to lay flat for writing and drawing purposes.

Locking element 30*b* is attached to the binder by first being fastened around adjacent coil 24. As in other locking elements described, 20 is compressed inboard toward 24, contacting ends of 30*b* are separated to pass upper hooked end through aperture 20 is then released, etc.

From the foregoing description, it can be seen that the present invention comprises an improved reusable/-refillable spiral binder for papers and the like. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A binder for papers having marginal perforations, said binder comprising:

a) a binding element adapted to be received within said perforations on said papers in threaded relation thereof, said binding element including opposite coiled ends and a plurality of spiral coils disposed therebetween, each of said coils having a predetermined pitch value and a predetermined cross-sectional area, at least one of said coiled ends having an aperture therethrough; and b) a removable locking element coupled to said aperture at least at one of said coiled end of said binding element whereby said predetermined pitch values and cross-sectional area of said coils facilitate threading and unthreading of said binding element with respect to said perforations and said removable locking element prevents relative rotation of said plurality of spiral coils when said binding element is received within said perforations.

2. The binder according to claim 1, wherein said binding element comprises a flat strip of coiled material.

3. The binder according to claim 2, wherein said coiled ends are provided with tapered leading edges.

4. The binder according to claim 1, wherein each of said removable locking elements comprises first and second ends, said first end extending through said aperture at said respective coiled end of said binding element and said second end encircling said spiral coil adjacent said respective coiled end of said binding element.

5. The binder according to claim 4, wherein said second end of said locking element partially encircles said spiral coil adjacent said respective coiled end of said binding element.

6. The binder according to claim 5, wherein said removable locking element is of low profile in shape in the longitudinal direction permitting full 360 degrees rotation of said papers.

7. The binder according to claim 4, wherein said second end of said locking element completely encircles said spiral coil adjacent said respective coiled end of said binding element.

8. The binder according to claim 7, wherein said removable locking element is of low profile in shape in the longitudinal direction permitting full 360 degrees rotation of said papers.

9. The binder according to claim 8, wherein said removable locking element includes a large surface area in the radial direction, whereby a suitable fingerhold for easier manipulation of said removable locking element is provided.

10. The binder according to claim 1, wherein each of said removable locking elements comprises a body portion, a first hooked end and a second hooked end removably coupled to said first hooked end, said locking element extending through said aperture at said respective coiled end of said binding element and encircling said spiral coil adjacent said respective coiled end of said binding element.

11. The binder according to claim 10, wherein said second hooked end is removably coupled to said first hooked end with a snap-fit.

12. A binder for papers having marginal perforations, said binder comprising:

a) a binding element comprising a flat strip of coiled material and adapted to be received within said perforations on said papers in threaded relation thereof, said binding element including opposite coiled ends and a plurality of spiral coils disposed therebetween, each of said coiled ends having an aperture therethrough; and b) a removable locking element coupled to said aperture at each respective coiled end of said binding element and one of said plurality of spring coils to prevent rotation of said spiral coils and thus unbinding of said papers from said binder.

13. The binder according to claim 12, wherein said coiled ends of said binding element are provided with tapered leading edges.

14. A binding construction comprising:

a) a stack of sheets having marginal perforations;

b) a relatively rigid cover overlying said stack, said cover including marginal perforations in register with said perforations in said stack;

c) a binding element extending through said respective perforations in said stack and said cover, said binding element including opposite coiled ends and a plurality of spiral coils disposed therebetween, each of said coiled ends including an aperture therethrough; and d) a removable locking element coupled to said aperture at each respective coiled end of said binding element and one of said plurality of spiral coils to prevent rotation of said spiral coils and thus unbinding of said sheets and covers from said binding construction.

15. The binding construction according to claim 14, wherein said binding element comprises a flat strip of material.

16. The binding construction according to claim 15, wherein said coiled ends of said binding element are provided with tapered leading edges.

17. The binding construction according to claim 14, wherein each of said removable locking elements comprises first and second ends, said first end extending through said aperture at said respective coiled end of said binding element and said second end encircling said spiral coil adjacent said respective coiled end of said binding element.

18. The binding construction according to claim 17, wherein said second end of said locking element partially encircles said spiral coil adjacent said respective coiled end of said binding element.

* * * * *